US007874855B1

(12) United States Patent
Ye et al.

(10) Patent No.: US 7,874,855 B1
(45) Date of Patent: Jan. 25, 2011

(54) AUDIO JACK CONNECTOR

(75) Inventors: Chao-Yong Ye, Guang-Dong (CN); Kai-Hsiang Chang, Tu-Cheng (TW); Kuo-Chin Lin, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/832,931

(22) Filed: Jul. 8, 2010

(51) Int. Cl.
*H01R 29/00* (2006.01)

(52) U.S. Cl. ..... 439/188; 439/668

(58) Field of Classification Search ..... 439/188, 439/668, 669
See application file for complete search history.

(56) References Cited

U.S. PATENT DOCUMENTS 7,785,119 B1 * 8/2010 Chiang ..... 439/188
2007/0232150 A1 * 10/2007 Lee ..... 439/668

* cited by examiner

*Primary Examiner*—Tho D Ta
(74) *Attorney, Agent, or Firm*—Cheng-Ju Chiang

(57) ABSTRACT

An audio jack connector has an insulating housing having a passageway. A contacting terminal disposed on a side of the passageway has a holding portion and two contacting pieces slanted toward the same side separatively from two opposite ends of the holding portion. A first fixing terminal arranged on a side of the passageway, adjacent to the contacting terminal, has a first fixing slice. The first fixing slice has a side extended obliquely to form a first contacting piece connecting with one contacting piece. A second fixing terminal placed on an opposite side of the passageway has a second fixing slice, a second contacting piece obliquely connected with the second fixing slice for connecting with the other contacting piece. The contacting pieces are forced to slide on and depart from the first contacting piece and the second contacting piece when the contacting terminal is elastically pushed by the inserted plug.

18 Claims, 6 Drawing Sheets

AUDIO JACK CONNECTOR

BACKGROUND OF THE INVENTION

1. Field of the Invention

The present invention relates to a connector, and particularly to an audio jack connector with switch terminals mounted therein.

2. The Related Art

Please refer to FIGS. 11-14, a conventional audio jack connector 100' includes an insulating housing 1', a shell 2' coupled with the insulating housing 1', and a set of switch terminals mounted into the insulating housing 1'. The set of switch terminals has a connecting terminal 3', a pair of contact terminals 4' and two insulating blocks 5'. The connecting terminal 3' has two abreast first connecting strips 33', and a second connecting strip 31' which has two opposite ends connected to two flush sides of the first connecting strips 33'. A side of each first connecting strip 33' opposite to the second connecting strip 31' has an upper end extended outwards to form a contacting piece 34'. A lower end of the first connecting strip 33' is defined as a first soldering end 35'. The second connecting strip 31' has middle portions of two opposite sides extending toward the same side to form two clipping pieces 32'. The clipping pieces 32' face each other and are located between the two first connecting strip 33'. The contact terminal 4' has a main body 41' of inverted-L shape. The main body 41' defines a level leg and an upright leg. A free end of the level leg is folded upwards with respect to the level leg to form a contacting arm 42'. The upright leg has a lower end defined as a second soldering end 44'. A buckling piece 43' is extended from an inner side of the upright leg and adjacent to the level leg. In assembly, the clipping pieces 32' and the buckling pieces 43' are engaged with the insulating housing 1'. The first soldering ends 35' and the second soldering ends 44' are soldered to a printed circuit board (PCB, not shown). The contacting arms 42' are attached to outer surfaces of the respective contacting pieces 34' for achieving the electrical connection. The insulating blocks 5' are respectively molded to the contacting arms 42'.

When an audio plug 7' is inserted into the audio jack connector 100', the insulating blocks 5' are pushed by the inserted audio plug 7' to move separatively so that the contacting arms 42' depart from the corresponding contacting pieces 34'. However, in the process, the audio plug 7' scrapes the insulating blocks 5', it may generate trifles from the insulating blocks 5'. Furthermore, the contacting arm 42' has a free end overlapped and attached to the contacting pieces 34' for achieving the electrical connection, once there is substrate accidentally sandwiched between the contacting arm 42' and the contacting piece 34', the connecting terminal 3' is unable to connect with the contact terminals 4' even the audio plug 7' is withdrawn, which affects the normal use of the audio jack connector 100'.

SUMMARY OF THE INVENTION

Accordingly, an object of the present invention is to provide an audio jack connector. The audio jack connector adapted for receiving an audio plug has an insulating housing having a passageway at a front thereof for receiving the plug. At least one contacting terminal is disposed on a first side of the passageway, and has a holding portion of strip shape, and two contacting pieces extended toward the same side with respect to the holding portion obliquely and separatively from two opposite ends of the holding portion. A first fixing terminal is arranged on a second side of the passageway, adjacent to the contacting terminal, and has a first fixing slice. The first fixing slice has at least one side extended obliquely to form a first contacting piece for electrically connecting with one contacting piece of the contacting terminal. A second fixing terminal is placed on a third side of the passageway opposite to the first fixing terminal. The second fixing terminal has a second fixing slice, a second contacting piece disposed obliquely and connected with the second fixing slice for electrically connecting with the other contacting piece of the contacting terminal. The contacting pieces are forced to slide on and depart from the first contacting piece and the second contacting piece when the contacting terminal is elastically pushed by the inserted plug.

Another object of the present invention is to provide an audio jack connector. The audio jack connector adapted for receiving an audio plug has an insulating housing having a passageway for receiving the plug. Two contacting terminals are disposed at an upper side and a lower side of the passageway, respectively and symmetrically. The contacting terminals have two facing holding portions, and contacting pieces slanted separatively toward each other from opposite ends of the holding portions. A first fixing terminal arranged at a side of the passageway, has a first fixing slice. The first fixing slice has two opposite sides extended obliquely and separatively toward the same side of the first fixing slice to form two first contacting pieces for connecting with one contacting piece of each contacting terminal, respectively and electrically. A second fixing terminal is placed at an upper portion of an opposite side of the passageway, and has a second fixing slice. A second contacting piece is disposed obliquely and connected with the second fixing slice by a front end of a lower side thereof jointed to a top side of the second fixing slice for connecting with the other contacting piece of the upper contacting terminal. A third fixing terminal is placed below the second contacting piece of the second fixing terminal. The third fixing terminal has a third fixing slice, a third contacting piece extended upwards from a middle portion of a top side of the third fixing slice, and bent obliquely and downwardly for connecting with the other contacting piece of the lower contacting terminal. The contacting pieces are slid at and departed from the first contacting pieces, the second contacting piece and the third contacting piece when the two contacting terminals are pushed by the inserted plug.

As described above, the audio jack connector provides the contacting terminals and the first fixing terminal, the second fixing terminal and the third fixing terminal. The connection between the contacting terminals and the first fixing terminal, the second fixing terminal and the third fixing terminal are by the means of oblique slide, which is effective to prevent the occurrence of bad connection resulted from substrate accidentally sandwiched therebetween.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
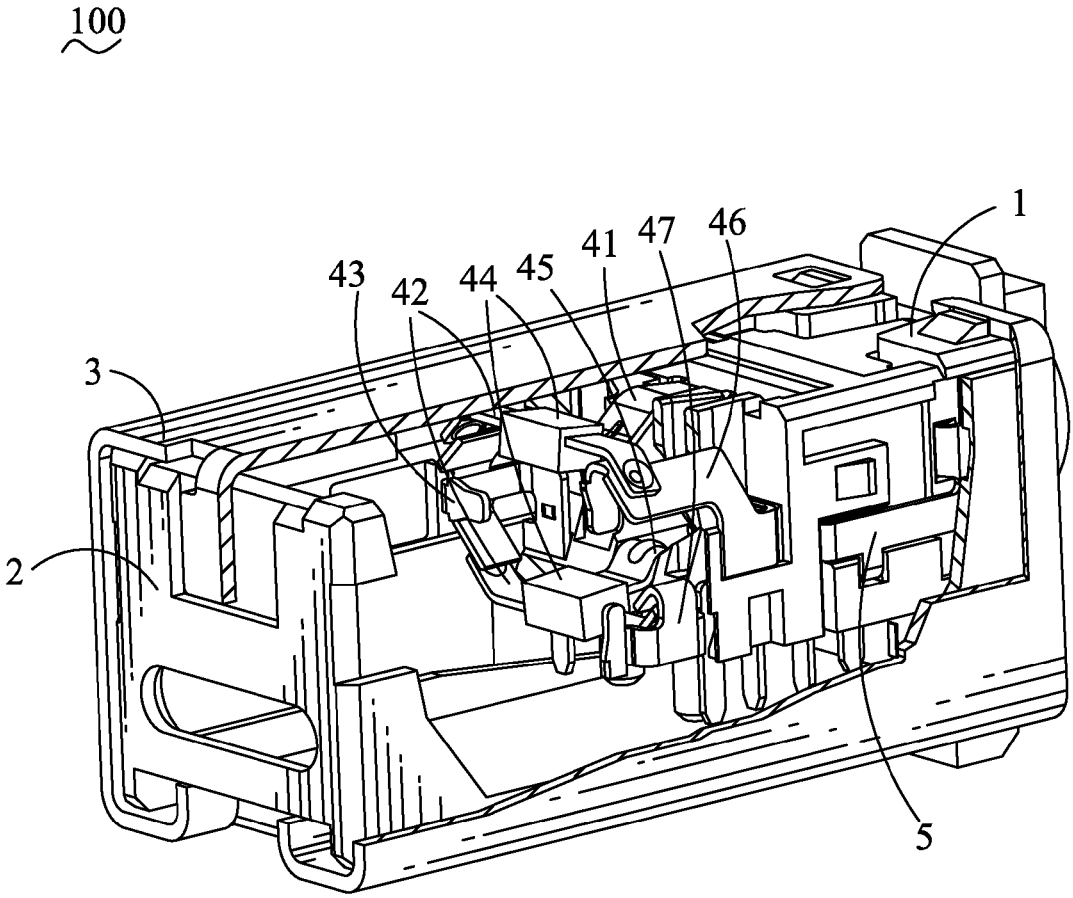
FIG. 1 is a partial cross-sectional view of an audio jack connector of an embodiment in accordance with the present invention.
Figure 2:
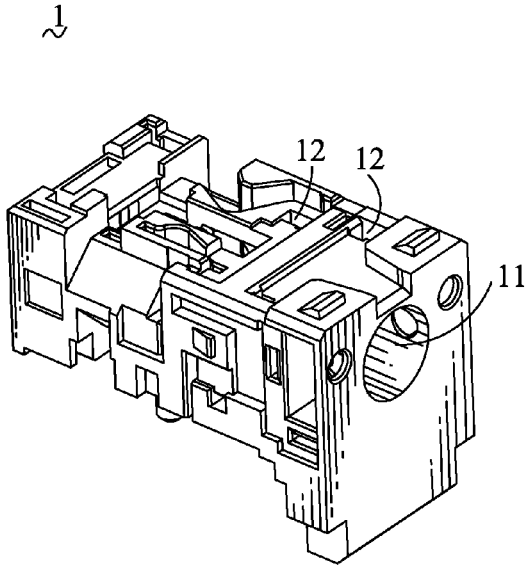
FIG. 2 is a perspective view of an insulating housing of the audio jack connector shown in FIG. 1.

Referring to the drawings in greater detail, and refer to FIGS. 1-2, the embodiment of the invention is shown in an audio jack connector 100. The audio jack connector 100 includes an insulating housing 1, a case 2 surrounding the insulating housing 1, a shell 3 covering the case 2, a first audio terminal 41, a second audio terminal 45, two insulating blocks 44, a first set of switch terminals, a second set of switch terminals and a plurality of signal terminals 5.

With reference to FIG. 2, the insulating housing 1 is a substantially rectangular shape, and has a passageway 11 at a front thereof for receiving an audio plug 6 (shown in FIG. 10), and a plurality of receiving recesses 12 communicating with the passageway 11.

Figure 3:
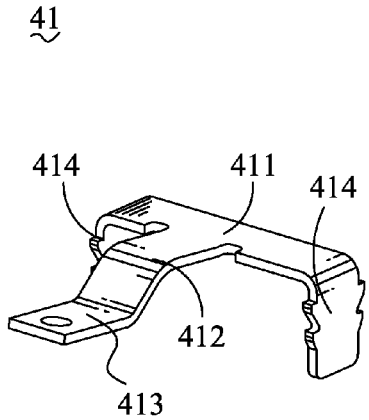
FIG. 3 is a perspective view of a first audio terminal of the audio jack connector shown in FIG. 1.
Figure 6:
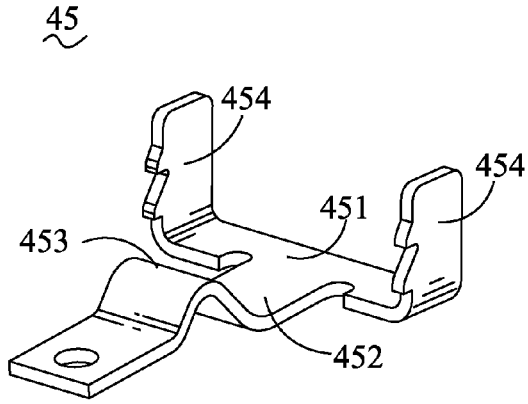
FIG. 6 is a perspective view of a second audio terminal of the audio jack connector shown in FIG. 1.

Please refer to FIG. 1, FIG. 3 and FIG. 6, the first audio terminal 41 has a first connecting portion 411 of strip shape, and two first buckling portions 414 extended downwards from two opposite ends of the first connecting portion 411. A middle portion of a rear side of the first connecting portion 411 is extended rearwards and bent downwards to form a first transition portion 412. The first transition portion 412 is substantially an arc shape. A free end of the first transition portion 412 is extended rearwards to form a first contacting end 413. The structure of the second audio terminal 45 is substantially same as that of the first audio terminal 41. The second audio terminal 45 has a second connecting portion 451, a second transition portion 452, a second contacting end 453 and a pair of second buckling portions 454. Herein, the second transition portion 452 is extended rearwards from a rear side of the second connecting portion 451. The second contacting end 453 has a portion adjacent to the second transition portion 452 arched upwards to show an arc shape.

Figure 4:
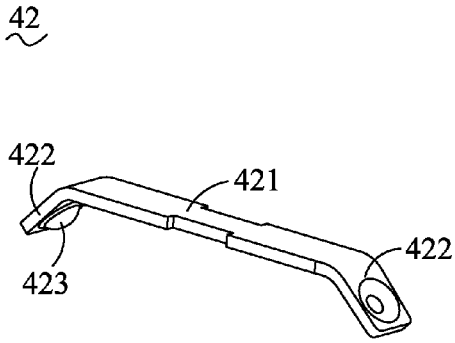
FIG. 4 is a perspective view of a contacting terminal of the audio jack connector shown in FIG. 1.

Referring to FIG. 1 and FIG. 4, the first set of switch terminals comprises a contacting terminal 42, a first fixing terminal 43 and a second fixing terminal 46. The contacting terminal 42 is a strip shape and has a holding portion 421, and two contacting pieces 422 slanting downwards from two opposite ends of the holding portion 421. Each of the contacting pieces 422 has a contacting lump 423 at a lower surface thereof. In this embodiment, there are two contacting terminals, defined as an upper contacting terminal and a lower contacting terminal, respectively. Herein, the upper contacting terminal 42 is involved in the first set of switch terminals.

Figure 5:
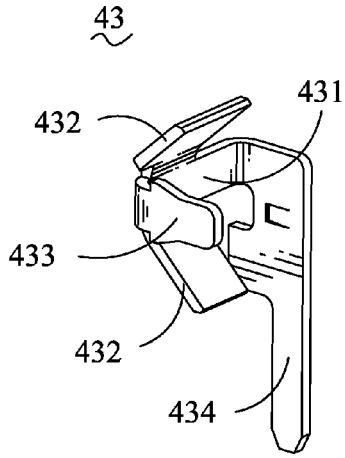
FIG. 5 is a perspective view of a first fixing terminal of the audio jack connector shown in FIG. 1.
Figure 7:
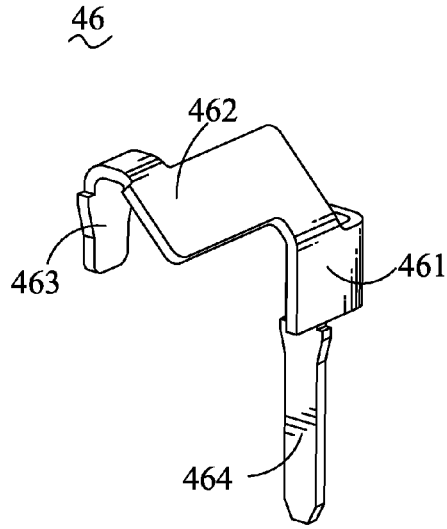
FIG. 7 is a perspective view of a second fixing terminal of the audio jack connector shown in FIG. 1.

Referring to FIG. 5 and FIG. 7, the first fixing terminal 43 has a rectangular first fixing slice 431. The first fixing slice 431 has two opposite ends extended toward the same side to form a first buckling piece 433 and a first soldering peg 434. The first soldering peg 434 extends downwards beyond the first fixing slice 431 with a predetermined distance. Two opposite sides of the first fixing slice 431 are extended obliquely toward the same side as the first buckling piece 433 with respect to the first fixing slice 431 to form a pair of first contacting pieces 432. The first contacting pieces 432 slant upwardly and downwardly, respectively. The second fixing terminal 46 has a rectangular second fixing slice 461. The second fixing slice 461 has a front end bent perpendicular to the second fixing slice 461 and extending downwards to form a second soldering peg 464. A second contacting piece 462 is disposed obliquely at the same side as the second soldering peg 464 with respect to the second fixing slice 461, and connected with the second fixing slice 461 by a front end of a lower side thereof jointed to a top side of the second fixing slice 461. The second contacting piece 462 is rectangular and prolonged rearwards beyond a rear end of the second fixing slice 461. An upper side of the second contacting piece 462 has a rear end bent downwards to form a second buckling piece 463.

Figure 8:
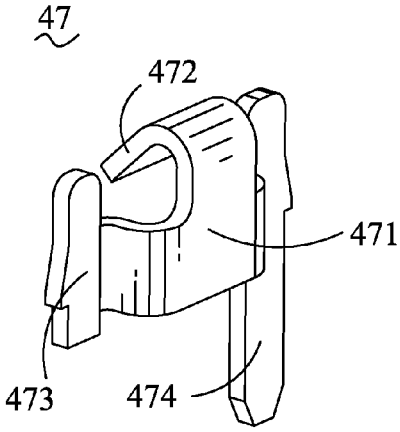
FIG. 8 is a perspective view of a third fixing terminal of the audio jack connector shown in FIG. 1.

Please refer to FIG. 1 and FIG. 8, the second set of switch terminals comprises the lower contacting terminal 42, and a third fixing terminal 47. The third fixing terminal 47 has a third fixing slice 471 of substantially inverted-U shape. Two ends of the third fixing slice 471 are extended opposite to each other to form a third buckling piece 473 and a third soldering peg 474. The third soldering peg 474 extends downwardly beyond the third fixing slice 471. A third contacting piece 472 is extended upwards from a middle portion of a top side of the third fixing slice 471, and bent toward the same side as two arms of the third fixing slice 471 with respect to a middle portion of the third fixing slice 471.

Figure 9:
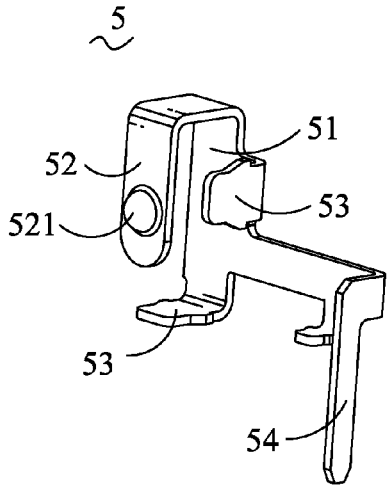
FIG. 9 is a perspective view of a signal terminal of the audio jack connector shown in FIG. 1.

Referring to FIG. 1 and FIG. 9, the signal terminal 5 has a rectangular main body 51. An upper end of the main body 51 is extended perpendicularly and bent downwards to form a contacting portion 52 of inverted-L shape. A free leg of the contacting portion 52 has a surface opposite to the main body 51 protruded outwards to form a contacting bump 521. A lower end of the main body 51 is extended perpendicularly to form a buckling portion 53. The buckling portion 53 faces to a leg of the contacting portion 52 perpendicular to the main body 51. A rear side of the main body 51 has a portion adjacent to the buckling portion 53 extended rearwards and bent downwards to form a soldering portion 54. The rear side of the main body 51 further has a buckling portion 53 above the soldering portion 54.

Figure 10:
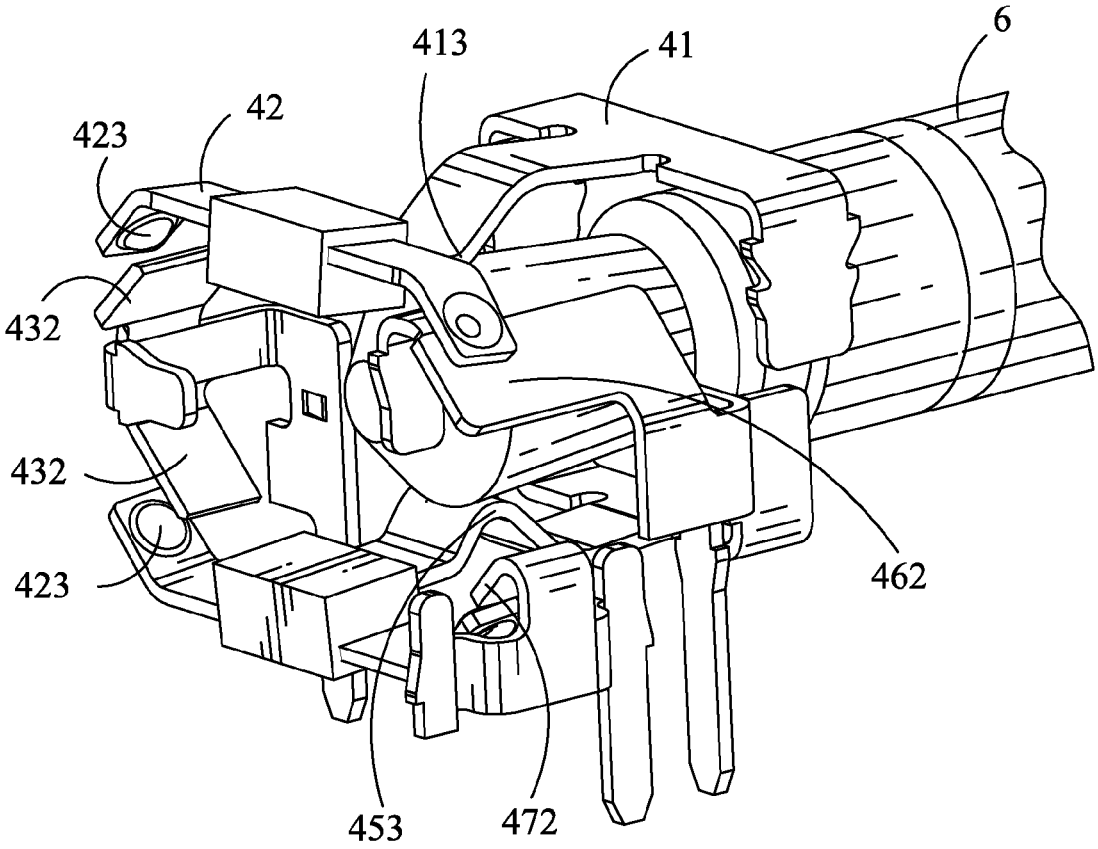
FIG. 10 is a plan view showing the engagement between the audio jack connector of FIG. 1 and an audio plug, wherein the insulating housing, a case and a shell are removed.
Figure 11:
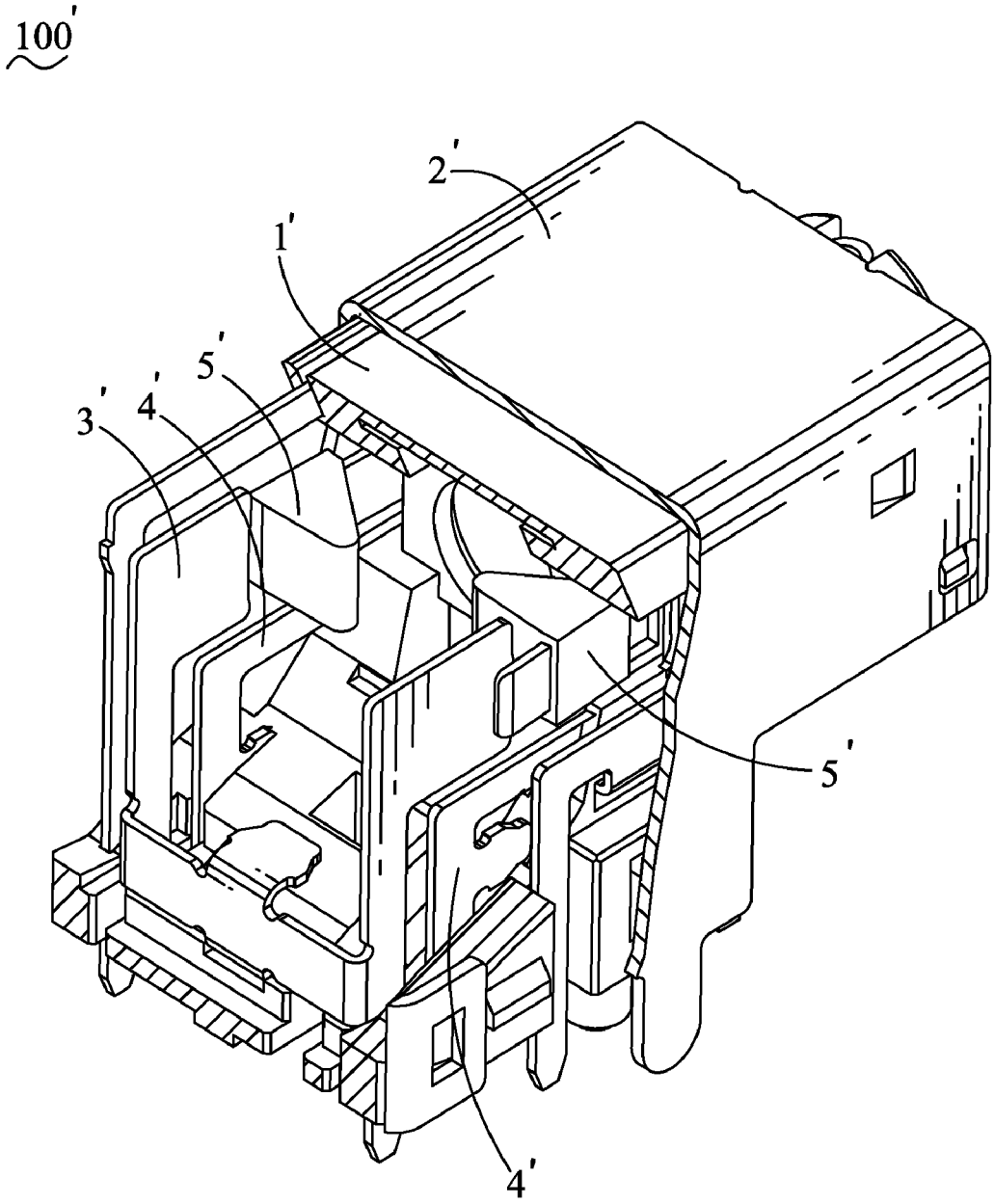
FIG. 11 (Prior Art)
FIG. 11 is a partial cross-sectional view of an audio jack connector in prior art.
Figure 12:
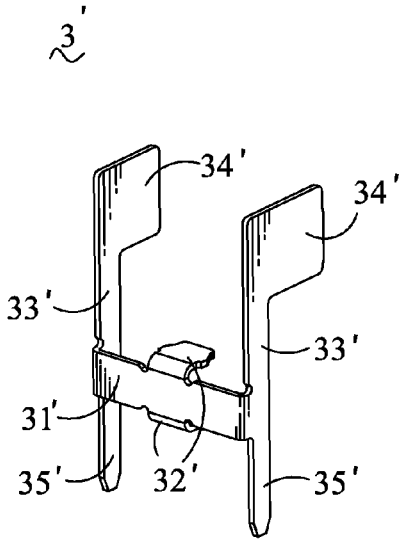
FIG. 12 (Prior Art)
FIG. 12 is a perspective view of a connecting terminal of the audio jack connector shown in FIG. 11.
Figure 13:
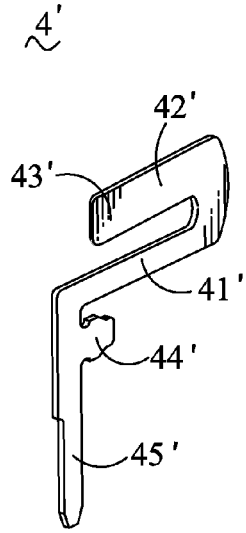
FIG. 13 (Prior Art)
FIG. 13 is a perspective view of a contact terminal of the audio jack connector shown in FIG. 11.
Figure 14:
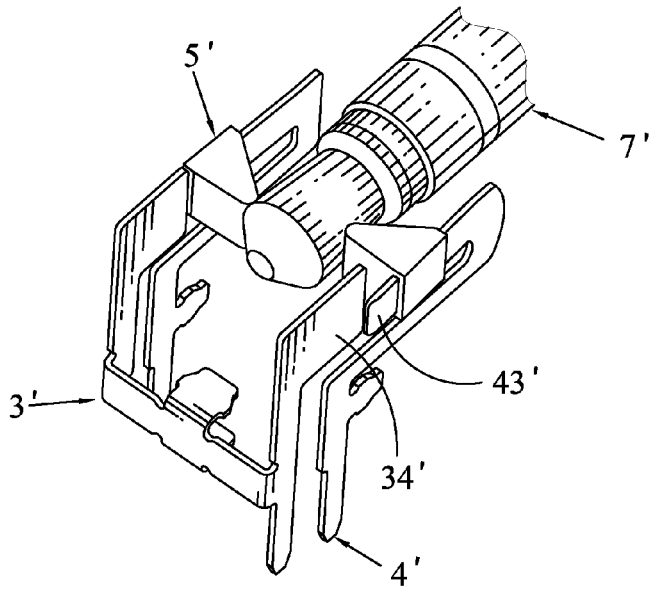
FIG. 14 (Prior Art)
FIG. 14 is a plan view showing the engagement between the audio jack connector of FIG. 11 and an audio plug, wherein an insulating housing and a shell are removed.

Please refer to FIG. 1 and FIG. 10, in assembly, the upper and lower contacting terminals 42 are symmetrically disposed at an upper side and a lower side of the passageway 11. The insulating blocks 44 are respectively molded to middle portions of the holding portions 421 of the contacting terminals 42. The first audio terminal 41 and the second audio terminal 45 are respectively located forward of the upper and lower contacting terminals 42. The first contacting end 413 and the second contacting end 453 project into the passageway 11, and have free ends molded with the insulating blocks 44, spaced from the holding portions 421. The first fixing terminal 43 is arranged at one side of the passageway 11, between the two contacting terminals 42. The two first contacting pieces 432 rest against one contacting lump 423 of the upper contacting terminal 42 and one contacting lump 423 of the lower contacting terminal 42, respectively. The second and third fixing terminals 46, 47 are disposed at the other side of the passageway 11, opposite to the first fixing terminal 43. The second contacting piece 462, located above the third fixing terminal 47, connects with the other contacting lump 423 of the upper contacting terminal 42. The third contacting piece 472 contacts the other contacting lump 423 of the lower contacting terminal 42. The signal terminal 5 is placed forward of the second fixing terminal 46. The contacting portion 52 projects into the passageway 11 for electrically connecting with the inserted plug 6. The first buckling portions 414, the second buckling portion 454, the first buckling piece 433, the second buckling piece 463, the third buckling piece 473, and the buckling portion 53 are fixed in the receiving recesses 12 of the insulating housing 1. The first soldering peg 434, the second soldering peg 464, and the third soldering peg 474, and the soldering portion 54 are soldered to a printed circuit board (PCB, not shown).

When the plug 6 is inserted into the passageway 11 of the audio jack connector 100, the first contacting end 413 is pushed and moves upwards so that the upper contacting terminal 42 is forced to move upwards. The contacting lumps 423 are slid on and departed from the first contacting piece 432 of the first fixing terminal 43 and the second contacting piece 462 of the second fixing terminal 46. When the plug 6 is further inserted into the passageway 11, the second contacting end 453 is pushed and moves downwards so that the lower contacting terminal 42 is forced to move downwards. The contacting lumps 423 are slid on and departed from the first contacting piece 432 of the first fixing terminal 43 and the third contacting piece 472 of the third fixing terminal 47. Therefore, the audio jack connector 100 is equipped with the first set of the switch terminals and the second set of the switch terminals for monitoring the insertion state of the plug 6. When the plug 6 is withdrawn, the two contacting terminals 42 resiliently restore and return the original position to connect with the first fixing terminal 43, the second fixing terminal 46 and the third fixing terminal 47.

As described above, the two insulating blocks 44 are respectively molded with the first audio terminal 41 and the upper contacting terminal 42, and the second audio terminal 45 and the lower contacting terminal 42, furthermore, the first audio terminal 41 and the second audio terminal 45 are respectively spaced from the upper contacting terminal 42 and the lower contacting terminal 42 in the corresponding insulating blocks 44, which simplifies the assembling structure and reduces the occupied space. Furthermore, the connection between the contacting terminals 42 and the first fixing terminal 43, the second fixing terminal 46 and the third fixing terminal 47 are by the means of oblique slide, which is effective to prevent the occurrence of bad connection resulted from substrate accidentally sandwiched therebetween.

What is claimed is:

1. An audio jack connector adapted for receiving an audio plug, comprising:

an insulating housing having a passageway at a front thereof for receiving the plug;

at least one contacting terminal disposed on a first side of the passageway, the contacting terminal having a holding portion of strip shape, and two contacting pieces extended toward the same side with respect to the holding portion obliquely and separatively from two opposite ends of the holding portion;

a first fixing terminal arranged on a second side of the passageway, adjacent to the contacting terminal, the first fixing terminal having a first fixing slice, the first fixing slice having at least one side extended obliquely to form a first contacting piece for electrically connecting with one contacting piece of the contacting terminal;

a second fixing terminal placed on a third side of the passageway opposite to the first fixing terminal, the second fixing terminal having a second fixing slice, a second contacting piece disposed obliquely and connected with the second fixing slice for electrically connecting with the other contacting piece of the contacting terminal;

wherein the contacting pieces are forced to slide on and depart from the first contacting piece and the second contacting piece when the contacting terminal is elastically pushed by the inserted plug.

2. The audio jack connector as claimed in claim 1, further comprising an audio terminal located forward of the contacting terminal, the audio terminal having a contacting end extending rearwards and projecting into the passageway, the contacting end having a free end spaced from and molded together with a middle portion of the holding portion, the contacting end being elastically pushed by the inserted plug to bring the contacting terminal to move and separate from the first fixing terminal and the second fixing terminal.

3. The audio jack connector as claimed in claim 2, wherein the audio terminal has a connecting portion of strip shape, and two buckling portions extended downwards from two opposite ends of the connecting portion and buckled in the insulating housing, a middle portion of a rear side of the connecting portion is extended rearwards and arched to form a transition portion, the contacting end is extended rearwards from a free end of the transition portion.

4. The audio jack connector as claimed in claim 1, wherein there are two contacting terminals which are disposed at an upper side and a lower side of the passageway, respectively and symmetrically.

5. The audio jack connector as claimed in claim 4, wherein the first fixing slice of the first fixing terminal has two opposite sides extended obliquely and separatively toward the same side of the first fixing slice to form two first contacting pieces for electrically connecting with one contacting piece of each contacting terminal.

6. The audio jack connector as claimed in claim 4, wherein the second fixing terminal is placed adjacent to the upper contacting terminal, the second contacting piece is connected with the second fixing slice by a front end of a lower side thereof jointed to a top side of the second fixing slice.

7. The audio jack connector as claimed in claim 6, further comprising a third fixing terminal placed adjacent to the lower contacting terminal, the third fixing terminal having a third fixing slice, a third contacting piece extended upwards from a middle portion of a top side of the third fixing slice, and bent obliquely and downwardly for electrically connecting with the contacting piece of the lower contacting terminal.

8. The audio jack connector as claimed in claim 1, wherein each of the contacting pieces has a contacting lump at an inner surface thereof for electrically connecting with the first contacting piece and the second contacting piece.

9. An audio jack connector adapted for receiving a plug, comprising:

an insulating housing having a passageway for receiving the plug;

two contacting terminals disposed at an upper side and a lower side of the passageway, respectively and symmetrically, the contacting terminals having two facing holding portions, and contacting pieces slanted separatively toward each other from opposite ends of the holding portions;

a first fixing terminal arranged at a side of the passageway, the first fixing terminal having a first fixing slice, the first fixing slice having two opposite sides extended obliquely and separatively toward the same side of the first fixing slice to form two first contacting pieces for connecting with one contacting piece of each contacting terminal, respectively and electrically;

a second fixing terminal placed at an upper portion of an opposite side of the passageway, the second fixing terminal having a second fixing slice, a second contacting piece disposed obliquely and connected with the second fixing slice by a front end of a lower side thereof jointed to a top side of the second fixing slice for connecting with the other contacting piece of the upper contacting terminal; and a third fixing terminal placed below the second contacting piece of the second fixing terminal, the third fixing terminal having a third fixing slice, a third contacting piece extended upwards from a middle portion of a top side of the third fixing slice, and bent obliquely and downwardly for connecting with the other contacting piece of the lower contacting terminal;

wherein the contacting pieces are slid at and departed from the first contacting pieces, the second contacting piece and the third contacting piece when the two contacting terminals are pushed by the inserted plug.

10. The audio jack connector as claimed in claim 9, wherein each of the contacting pieces has a contacting lump at an inner surface thereof for steady electrically connection.

11. The audio jack connector as claimed in claim 9, wherein one end of the first fixing slice is extended toward the same side as the first contacting pieces with respect to the first fixing slice to form a first buckling piece for fixing the first fixing terminal to the insulating housing.

12. The audio jack connector as claimed in claim 11, wherein the other end of the first fixing slice is extended toward the same side as the first contacting pieces with respect to the first fixing slice to form a first soldering peg, the first soldering peg extends downwards beyond the first fixing slice with a predetermined distance.

13. The audio jack connector as claimed in claim 9, wherein an upper side of the second contacting piece has a rear end bent downwards to form a second buckling piece for fixing the second fixing terminal to the insulating housing.

14. The audio jack connector as claimed in claim 13, wherein the second fixing slice has a front end bent perpendicular to the second fixing slice and extending downwards to form a second soldering peg.

15. The audio jack connector as claimed in claim 9, wherein the third fixing slice is substantially an inverted-U shape.

16. The audio jack connector as claimed in claim 15, wherein one end of the third fixing slice is bent outwards to form a third buckling piece for fixing the third fixing terminal to the insulating housing.

17. The audio jack connector as claimed in claim 16, wherein the other end of the third fixing slice is bent outwards to form a third soldering peg, the third soldering peg extends downwardly beyond the third fixing slice.

18. The audio jack connector as claimed in claim 15, wherein the third contacting piece is extended upwards from a middle portion of a top side thereof the third fixing slice, and bent toward the same side as two arms of the third fixing slice with respect to a middle portion of the third fixing slice.

* * * * *